United States Patent [19]

Boyd

[11] Patent Number: 4,914,761

[45] Date of Patent: Apr. 10, 1990

[54] REINFORCED CORNER FOR WATERBED MATTRESS

[76] Inventor: Dennis Boyd, 14457 Rouge River, Chesterfield, Mo. 63017

[21] Appl. No.: 260,452

[22] Filed: Oct. 20, 1988

[51] Int. Cl.[4] ..... A47C 27/08

[52] U.S. Cl. ..... 5/451; 156/157; 156/292; 156/304.3

[58] Field of Search ..... 5/451, 452, 450, 449, 5/455, 441; 156/304.3, 157, 292; 297/DIG. 3

[56] References Cited

U.S. PATENT DOCUMENTS

| | | | |
|---|---|---|---|
| 3,753,823 | 8/1973 | Kuss | 5/451 |
| 3,780,388 | 12/1973 | Thomas et al. | 297/DIG. 3 |
| 3,918,110 | 11/1975 | Cantillo et al. | 5/452 |
| 4,221,625 | 9/1980 | Fraige | 5/451 |
| 4,251,308 | 2/1981 | Miller | 5/451 |
| 4,611,357 | 9/1986 | Chelin | 5/451 |
| 4,745,649 | 5/1988 | Wang | 5/455 |

*Primary Examiner*—Alexander Grosz

*Attorney, Agent, or Firm*—Polster, Polster and Lucchesi

[57] ABSTRACT

An improved corner for a waterbed mattress includes a first layer of vinyl forming the corner with a seam disposed generally linearly along the corner. The seam is formed of two portions of the vinyl heat welded together along the seam. A second layer or patch of vinyl is welded to the first layer by a weld which encircles and is spaced from the seam in the first layer.

3 Claims, 2 Drawing Sheets

REINFORCED CORNER FOR WATERBED MATTRESS

BACKGROUND OF THE INVENTION

This invention relates to waterbed mattresses and more particularly to reinforcing the corners of said mattresses to prevent leakage.

Waterbed mattresses contain a large quantity of water which transmits substantial pressure throughout the interior of the mattress when a weight, such as the human body, is on the mattress. Even the weight of the water itself creates substantial pressure in the mattress.

These mattresses typically are made of a single layer of a plastic material such as vinyl. The thickness and other characteristics of the vinyl are selected to provide adequate strength to resist rupture of the mattress while at the same time providing a resilient feel to the mattress.

Since a waterbed mattress cannot be formed as a single, unitary piece, it is necessary to seal various portions of the vinyl together by heat welding or the like to form the completed mattress. These seams, particularly in the corners of the mattresses, often are the weakest part of the mattress and the place where the pressure can cause the mattress to rupture. Of course, the rupture may be small, which results in a relatively minor leakage of water from the mattress. Any such leakage is, however, unacceptable.

SUMMARY OF THE INVENTION

Among the various objects and features of the present invention may be noted the provision of a reinforced corner for a waterbed mattress which is both secure and durable.

Another object is the provision of such a corner with superior leak resistance.

A third object is the provision of such a corner which is relatively simple in construction.

A fourth object is the provision of a method of quickly and efficiently making the reinforced corner of the present invention.

Other objects and features will be in part apparent and in part pointed out hereinafter.

Briefly, the present invention relates to an improved corner for a waterbed mattress having a seam along at least one corner. The improved corner includes a first layer of plastic material such as vinyl forming the corner of the waterbed mattress with the seam disposed generally linearly along the corner. The seam is formed of two portions of the plastic layer welded together along the seam. A second layer of plastic material such as vinyl is welded to the first layer of vinyl by a weld which encircles and is spaced from the seam in the first layer.

The method of the present invention concerns making a reinforced corner for a waterbed mattress. It includes the steps of sealing two adjacent flaps of a plastic material such as vinyl together to form a seam at a corner of a waterbed mattress, which flaps are disposed so that the seam runs generally from the top to the bottom of the mattress, and sealing a patch of a plastic material such as vinyl to the corner around the seam to form a seal which is spaced from and encircles the seam, the portion of the patch inside the seal covering the seam.

BRIEF DESCRIPTION OF THE DRAWINGS

Similar reference characters indicate similar parts throughout the several views of the drawings.

DESCRIPTION OF THE PREFERRED EMBODIMENTS

A waterbed mattress 1 is constructed from a single sheet of a suitable plastic material such as vinyl. This requires that there be at least some seams, such as corner seam 11 and side seam 13, where the flaps of the vinyl meet. These flaps are sealed together by a suitable process such as heat welding, but (as pointed out above) the seams do provide a point of possible leakage when the waterbed mattress is inflated with water.

Figure 1:
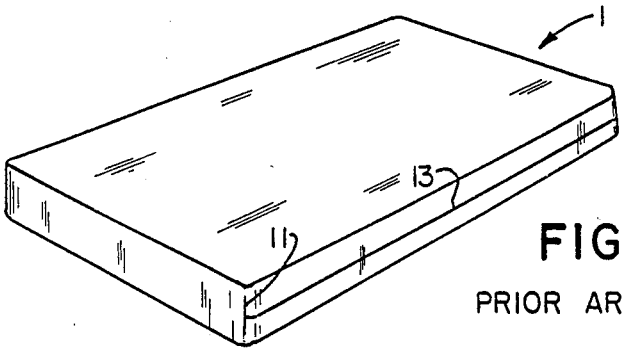
FIG. 1. PRIOR ART
FIG. 1 is a perspective view of a prior art waterbed mattress illustrating the seams in said mattress.
Figure 2:
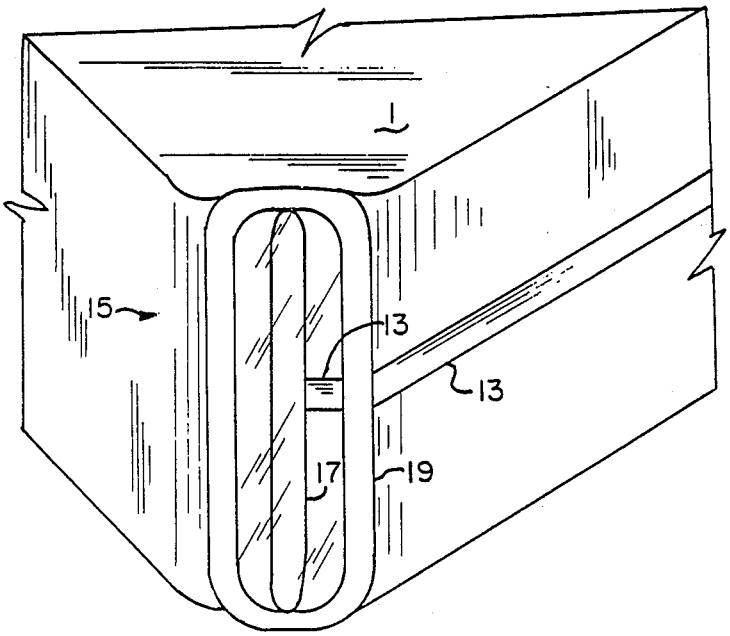
FIG. 2 is a perspective view of one embodiment of the improved corner of the present invention on a waterbed mattress.

A reinforced corner 15 (FIG. 2) is designed to significantly reduce the possibility of such leakage. Corner 15 includes not only the flaps of vinyl which are sealed together to form the seam, but also a reinforcing strip 17 disposed over the seam and welded thereto, and a cover patch 19 disposed over the reinforcing strip and sealed around the periphery thereof.

Reinforcing strip 17 and cover patch 19 are both made of vinyl like the mattress itself and are readily heat weldable thereto. Cover patch 19 is preferably a transparent vinyl so that the reinforcing strip can be seen through patch 19.

Figure 3:
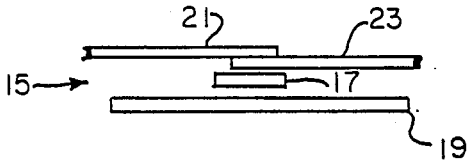
FIG. 3 is a top plan of the various layers of the corner of FIG. 2.
Figure 4:
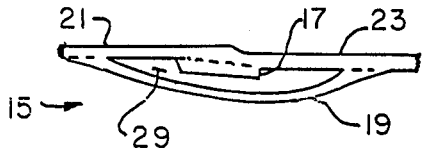
FIG. 4 is a top plan of the layers of FIG. 3 illustrating the construction after the layers are heat welded together.

The various layers of corner 15 are illustrated in more detail in FIGS. 3 and 4. The two flaps of vinyl, labelled 21 and 23, are overlapped as shown in FIG. 3 and lap welded as illustrated (in exaggerated fashion) in FIG. 4. This lap weld is performed in the conventional manner. A butt weld could be used instead, as is well known in the art.

Figure 5:
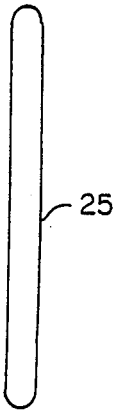
FIG. 5 is an elevation of a solid die used in one step of the method of the present invention.

Reinforcing strip 17 is about the same length and width as the seam 11. It is heat welded to the seam (FIG. 4) to completely cover seam 11. A solid die, such as die 25 (FIG. 5), is used to completely seal strip 17 to flaps 21 and 23.

Figure 6:
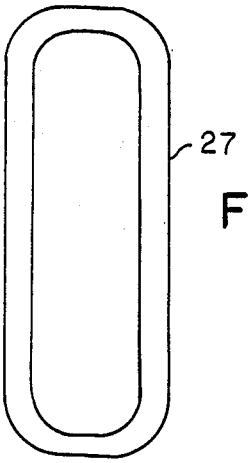
FIG. 6 is an elevation of a hollow die used in another step of the method of the present invention.

Cover layer or patch 19 is considerably larger than strip 17 in both directions and is heat welded to flaps 21 and 23 by means of a hollow die 27 (FIG. 6) having a raised edge which only seals the periphery of the patch to the flaps. This leaves an area, labelled 29 in FIG. 4, in which the patch is not welded to the flaps. Specifically, the weld of patch 19 surrounds the reinforcing strip, but is spaced therefrom. It is preferred that the weld joining the patch to the vinyl flaps of the mattress be totally separate from the lap weld joining the flaps to reduce the possibility of failure at the point where the welds might meet.

Figure 7:
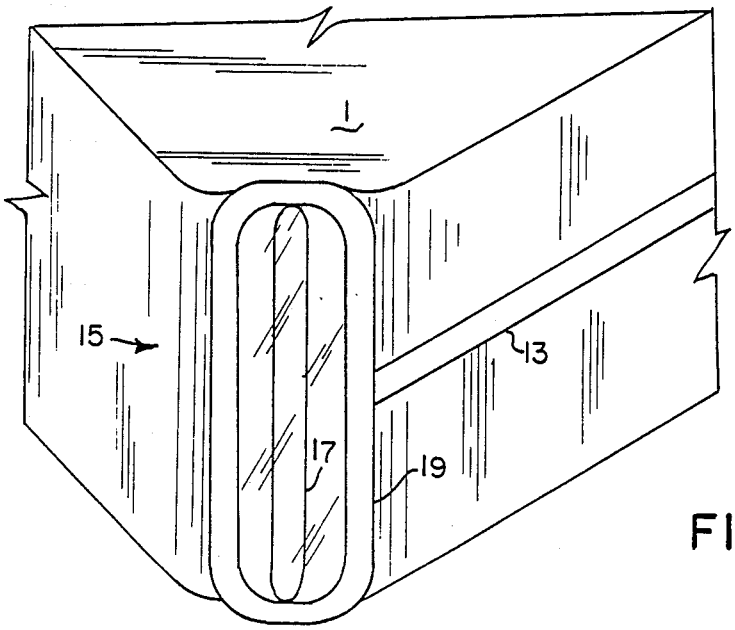
FIG. 7 is a perspective view of a second embodiment of the improved corner of the present invention.
Figure 8:
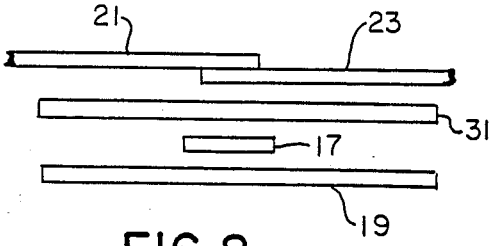
FIG. 8 is a top plan of the various layers of the corner of FIG. 7.
Figure 9:
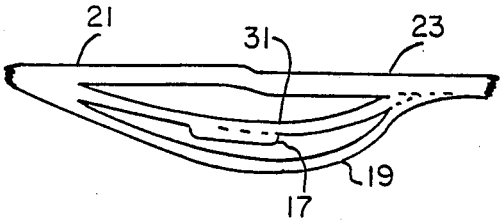
FIG. 9 is a top plan of the layers of FIG. 8 illustrating the construction of the corner of FIG. 7 after the layers are heat welded together.

A second embodiment of the present invention is illustrated in FIGS. 7 through 9. In this embodiment, an additional layer of vinyl 31, having generally the same dimensions as patch 19, is disposed between the flaps and cover patch 19. Both the patch and layer 31 are heat welded to flaps 21 and 23 in a single step using hollow die 27. It should be noted that reinforcing strip 17 in this embodiment is merely decorative, since it is welded not to the seam, but rather to intermediate layer 31.

Figure 10:
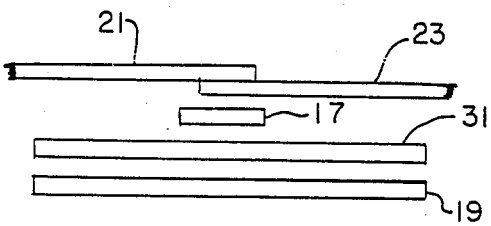
FIG. 10 is a top plan of the various layers of a third embodiment of the corner of the present invention.

In the embodiment of FIG. 10, on the other hand, reinforcing strip 17 is sealed to the seam using die 25, and patch 19 and layer 31 are sealed around the periphery of the seam using hollow die 27.

Numerous variations of the present invention, within the scope of the appended claims, will be apparent to those skilled in the art in light of the foregoing description and accompanying drawings. These variations are merely illustrative.

I claim:

1. In a waterbed mattress having a seam along at least one corner thereof, an improved corner comprising:

a first layer of plastic material such as vinyl forming said corner of the waterbed mattress with the seam disposed generally vertically along said corner and running generally from the top of the waterbed mattress to the bottom, said seam being formed of two portions of said plastic layer welded together along the seam; and a second layer of plastic material such as vinyl welded to the first layer of vinyl by a weld which encircles and is spaced from the seam in the first layer, and a third layer of plastic material such as vinyl, said third layer being generally the same size as the vertically disposed seam in the first layer and being welded to the vertically disposed seam in the first layer to reinforce said seam.

2. The improved corner as set forth in claim 1 further including an additional layer of plastic material such as vinyl welded to at least one of the first and second layers by a weld which encircles and is spaced from the seam in the first layer.

3. The improved corner as set forth in claim 2 wherein the additional layer is transparent.

* * * * *